US012642348B2

(12) United States Patent
Xu et al.

(10) Patent No.: US 12,642,348 B2
(45) Date of Patent: Jun. 2, 2026

(54) TOOTHBRUSH

(71) Applicant: SHANGHAI SHIFT ELECTRICS CO., LTD., Shanghai (CN)

(72) Inventors: Zhenwu Xu, Shanghai (CN); Xiaoguo Dai, Shanghai (CN); Changjin Zhang, Shanghai (CN); Hongtao Zhang, Shanghai (CN)

(73) Assignee: SHANGHAI SHIFT ELECTRICS CO., LTD., Shanghai (CN)

( * ) Notice: Subject to any disclaimer, the term of this patent is extended or adjusted under 35 U.S.C. 154(b) by 457 days.

(21) Appl. No.: 18/253,213

(22) PCT Filed: May 8, 2021

(86) PCT No.: PCT/CN2021/092432
§ 371 (c)(1),
(2) Date: May 17, 2023

(87) PCT Pub. No.: WO2022/105145
PCT Pub. Date: May 27, 2022

(65) Prior Publication Data

US 2023/0404727 A1 Dec. 21, 2023

(30) Foreign Application Priority Data

Nov. 18, 2020 (CN) ..... 202022678200.6

(51) Int. Cl.
*A46B 5/00* (2006.01)
*A46B 9/04* (2006.01)
*A46B 15/00* (2006.01)

(52) U.S. Cl.
CPC ..... *A46B 5/007* (2013.01); *A46B 9/04* (2013.01); *A46B 15/0012* (2013.01); *A46B 2200/1066* (2013.01)

(58) Field of Classification Search
CPC ... A46B 5/0062; A46B 5/0058; A46B 5/0054; A46B 5/007; A46B 9/04; A46B 2200/1066; A46B 5/0075
(Continued)

(56) References Cited

U.S. PATENT DOCUMENTS 5,499,422 A 3/1996 Lavazoli
12,402,718 B2 * 9/2025 Xu ..... A46B 5/007

FOREIGN PATENT DOCUMENTS

CN 2593630 Y 12/2003
CN 103494434 A * 1/2014 ..... A46B 13/08
(Continued)

OTHER PUBLICATIONS

English translation JP 3014097 U, Yoshio Chiyoda, 1995. (Year: 1995).*
International Search Report of PCT/CN2021/092432.

*Primary Examiner* — Laura C Guidotti
(74) *Attorney, Agent, or Firm* — Kilpatrick Townsend & Stockton LLP

(57) ABSTRACT

A toothbrush including a handle; a head; a connection structure including a first rotating disc and a second rotating disc that coaxially rotate, the first rotating disc being connected to the head/handle and the second rotating disc being connected to the handle/head, and a rotation axis of the first rotating disc and the second rotating disc being perpendicular to an extension direction of the handle; and an elastic structure including a first elastic member and a second elastic member, two ends of each of the first elastic member and the second elastic member being respectively connected to or abutting against the first rotating disc and the second rotating disc, and when the first rotating disc rotates with respect to the second rotating disc under the action of an
(Continued)

external force, the first elastic member and/or the second elastic member elastically deforming.

11 Claims, 5 Drawing Sheets

(58) Field of Classification Search
USPC ..... 15/167.1, 144.1
See application file for complete search history.

(56) References Cited

FOREIGN PATENT DOCUMENTS

| | | | | | |
|---|---|---|---|---|---|
| CN | 203828321 | U | | 9/2014 | |
| CN | 204048574 | U | | 12/2014 | |
| CN | 205072337 | U | | 3/2016 | |
| GB | 2413268 | A | * | 10/2005 | ..... A46B 15/0012 |
| JP | 3014097 | U | * | 8/1995 | ..... A46B 5/00 |
| JP | 3949781 | B2 | * | 7/2007 | ..... A46B 5/00 |
| TW | M589002 | U | | 1/2020 | |

* cited by examiner

TOOTHBRUSH

The present application claims the priority to the Chinese Patent Application No. 202022678200.6, filed in China Patent Office on 18 Nov. 2020 and entitled "TOOTHBRUSH", which is incorporated herein by reference in its entirety.

FIELD

The present application relates to the field of oral care, and in particular, to a toothbrush.

BACKGROUND ART

When a toothbrush is in use, the force of the toothbrush to clean teeth comes from pressing and pushing forces of a human hand. A better cleaning effect is desirable for a user when brushing teeth, and an increased pressing level will be unintentionally applied by a hand, and the teeth are subjected to a stress that exceeds what is required for cleaning, which may cause wear of tooth enamel and more likely cause discomfort and damage to a neck of a tooth where the tooth and a gum meet.

SUMMARY

Embodiments of the present application are to alleviate the issue of damages to teeth due to too hard brushing.

Embodiments of the present application are as follows.

A toothbrush, comprising:

a handle placed upright and whose long sides extend vertically;

a head having bristles for brushing teeth;

a connection structure including a first rotating disc and a second rotating disc which are arranged coaxially and rotatable relative to each other, the first rotating disc being connected to the head and the second rotating disc being connected to the handle, or the second rotating disc being connected to the head and the first rotating disc being connected to the handle, and the rotation axis of the first rotating disc and the second rotating disc being perpendicular to an extension direction of the handle; and an elastic structure including a first elastic member and a second elastic member, and the first elastic member is connected to or abuts against the first rotating disc at one end and is connected to the second rotating disc at the other end, or the second elastic member is connected to or abuts against the first rotating disc at one end and is connected to the second rotating disc at the other end; or the first elastic member is connected to the first rotating disc at one end and is connected to or abuts against the second rotating disc at the other end, and the second elastic member is connected to the first rotating disc at one end and is connected to or abuts against the second rotating disc at the other end.

When the first rotating disc rotates relative to the second rotating disc under the action of an external force, the first elastic member and/or the second elastic member elastically deform to generate an elastic restoring force that drives the first rotating disc to rotate reversely to return to its initial position after the external force is removed.

In one embodiment, the rotation axis is perpendicular to or parallel to an extension direction of the bristles.

In one embodiment, both the first elastic member and the second elastic member are strip-shaped structures and integrally provided, and the first elastic member and the second elastic member are connected to the first rotating disc at a connection.

In one embodiment, the second rotating disc is provided with a clamping block having a clamping groove.

The first elastic member and the second elastic member are clamped in the clamping groove at the connection.

In one embodiment, the first rotating disc is provided with a first protruding post and a second protruding post, the first protruding post and the second protruding post respectively abutting against the first elastic member and the second elastic member.

In one embodiment, free ends of the first elastic member and the second elastic member are located between the first protruding post and the second protruding post.

In one embodiment, both the first elastic member and the second elastic member are strip-shaped, and the first elastic member has a first arc-shaped section whose arc center faces the rotation axis and a second arc-shaped section whose arc center faces the first protruding post.

In one embodiment, a surface of the second rotating disc facing the first rotating disc is provided with a rotating cylinder, and the first rotating disc is sleeved on the rotating cylinder and rotates around the rotating cylinder.

The connection structure further includes a snap-fit member, the snap-fit member is in snap fit with the second rotating disc to form an accommodating cavity for accommodating the first rotating disc, and the snap-fit member and/or the second rotating disc are provided with an avoidance opening to avoid the connection between the first rotating disc and the head.

In one embodiment, the snap-fit member and/or the second rotating disc is provided with a drain hole communicating with the accommodating cavity.

In one embodiment, the toothbrush further includes a sensing structure for sensing the pressure on the head.

The embodiments of the toothbrush provided in the present application included in that the toothbrush provided in the present application can alleviate the issue of damages to teeth due to too hard brushing, providing the effect of protecting teeth.

DESCRIPTION OF THE DRAWINGS

To describe the embodiments of the present application more clearly, the following briefly describes the accompanying drawings required for describing the embodiments or the exemplary art. Apparently, the accompanying drawings in the following description show merely some of the embodiments of the present application.

LIST OF REFERENCE SIGNS

Figure 1:
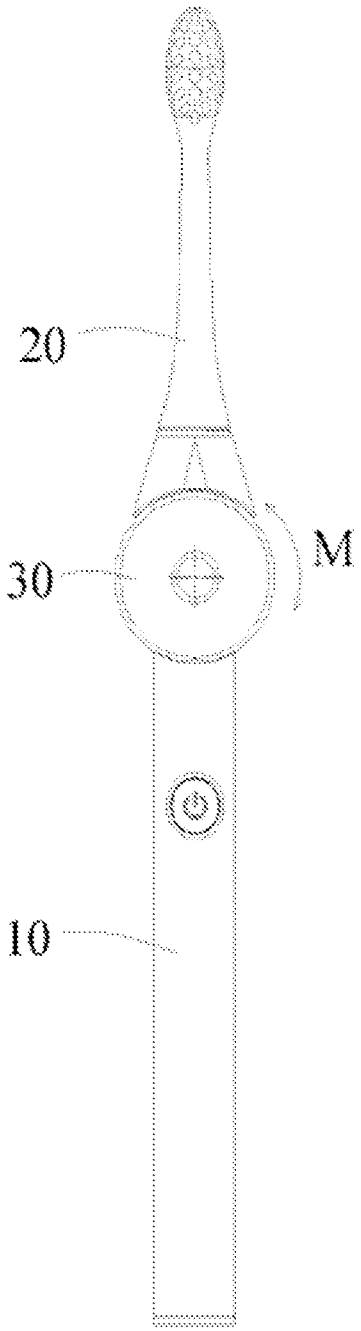
FIG. 1 is a first schematic view of a toothbrush according to an embodiment of the present application, with a rotation axis being parallel to an extension direction of bristles.

10. Handle; 20. Head; 30. Connection structure; 31. First rotating disc; 311. First protruding post; 312. Second protruding post; 32. Second rotating disc; 321. Clamping block; 322. Rotating cylinder; 33. Snap-fit member; 301. Avoidance opening; 302. Drain hole; 40. Elastic structure; A. First fixed end; B. First movable end; 41. First elastic member; 411. First arc-shaped section; 412. Second arc-shaped section; 42. Second elastic member.

DETAILED DESCRIPTION OF EMBODIMENTS

The embodiments of the present application more apparent, the present application will be further described in detail below in conjunction with the accompanying drawings and embodiments. It should be understood that embodiments described herein are intended only to explain the present application, and not to limit the present application.

It should be noted that when a component is referred to as being "fixed to" or "arranged on" another component, it may be directly or indirectly placed on the another component. When a component is referred to as being "connected to" another component, it may be directly or indirectly connected to the another component. The orientations or positional relationships indicated by the terms "upper", "lower", "left", "right", and the like are based on the orientations or positional relationships as shown in the accompanying drawings, and are only for ease of description, rather than indicating or implying that the device or element referred to must have a specific orientation or be constructed and operated in a specific orientation, and therefore cannot be construed as limiting the present application. The terms "first", "second" are merely intended for the purpose of ease of description, and shall not be understood as an indication or implication of relative importance or implicit indication of the number of features. The meaning of "a plurality of" is two or more, unless specifically defined otherwise.

Referring to FIGS. 1 to 5, a toothbrush according to the present application is illustratively described. The toothbrush includes a handle 10, a head 20, a connection structure 30, and an elastic structure 40.

The head 20 and the handle 10 are arranged one on top of another, and the head 20 and the handle 10 are connected by means of a connection structure 30, and rotate relative to each other by means of the connection structure 30. The elastic structure 40 is configured to elastically deform when the head 20 rotates relative to the handle 10, and drive the head 20 to return to its initial position after an external force is removed. The elastic deformation of the elastic structure 40 means that when the elastic structure 40 is subjected to the external force, relative positions of respective points inside the structure are changed to change the contour of the overall structure, and that the elastic structure has a capability to recover to its initial shape after the external force is removed.

For ease of description, the toothbrush is arranged upright. Long sides of the handle 10 extend vertically.

The head 20 is located above the handle 10 and has bristles for brushing teeth.

The connection structure 30 includes a first rotating disc 31 and a second rotating disc 32 that are arranged coaxially and are rotatable relative to each other. The first rotating disc 31 is fixedly connected to the head 20, and the second rotating disc 32 is fixedly connected to the handle 10, In one embodiment, the second rotating disc 32 is fixedly connected to the head 20, and the first rotating disc 31 is fixedly connected to the handle 10. The rotation axis of the first rotating disc 31 and the second rotating disc 32 are perpendicular to an extension direction of the handle 10. In the illustrated structure, the first rotating disc 31 is fixedly connected to the head 20, and the second rotating disc 32 is fixedly connected to the handle 10.

The first rotating disc 31 rotates relative to the second rotating disc 32 to enable the head 20 to rotate relative to the handle 10. The rotation axis is perpendicular to the extension direction of the handle 10, and the extension direction of the handle 10 is in a vertical direction, thus the rotation axes extend on a horizontal plane. The head 20 rotates in a direction of the handle 10 and the bristles are offset downwards and outwards away from their initial positions directly above the handle 10. The elastic structure 40 elastically deform when the bristles are offset away from the initial position due to an external force, and drives the head 20 to rotate in an opposite direction after the external force is removed and the bristles return to their initial positions.

In combination with the operation of brushing teeth, when teeth are brushed, the toothbrush is generally placed horizontally, and the head 20 extends into a mouth laterally (the length direction of the toothbrush is parallel to the arrangement direction of the teeth), and brushes upper teeth and lower teeth longitudinally. It should be noted that an acting force on the teeth when the teeth are brushed may be represented by a static pressure of the bristles on the teeth and a pushing force for relative movement between the bristles and the teeth.

In the case of an excessive pressure, the head 20 rotates around the rotation axis, and elastic members elastically deform to counteract the influence of part of the acting force on the teeth, and the actual pressure on the teeth is reduced.

FIG. 1 shows that the rotation axis is parallel to the extension direction of the bristles. If the rotation axis is parallel to the extension direction of the bristles, the head 20 rotates in a direction indicated by M in the figure. Assuming that the toothbrush carries out brushing from the middle with a fixed pushing force alternately in the direction of the upper teeth and the lower teeth, the head 20 rotates in the opposite direction; when the toothbrush carries out brushing in the direction of the upper teeth, the head 20 rotates in the direction of the lower teeth, correspondingly, when the toothbrush carries out brushing in the direction of the lower teeth, the head 20 rotates in the direction of the upper teeth. The elastic members elastically deform to counteract the part of the pushing force, and the actual pressure on the teeth is reduced to protect the teeth. It should be further noted that since there is a linear relationship between the amount of deformation of the elastic members and a frictional force, when the upper teeth and lower teeth are brushed by the toothbrush, the actual pressure on the teeth decreases from the crown to the gum, and the pressure on the gum is the smallest to further protect the gum.

If the rotation axis is perpendicular to the extension direction of the bristles, when the teeth are brushed, the bristles face and press against the teeth. In the case of excessive static pressure, the head 20 rotates away from the teeth, and the elastic member elastically deform to counteract part of the pressure, and the actual static pressure on the teeth is reduced, to protect the teeth.

From the above analysis, the toothbrush provided in this embodiment may have the effect of protecting teeth.

The elastic structure 40 includes a first elastic member 41 and a second elastic member 42, and the first elastic member 41/second elastic member 42 are connected to or abut against the first rotating disc 31 at one end and are connected to the second rotating disc 32 at the other end, or the first elastic member 41/second elastic member 42 are connected to the first rotating disc 31 at one end and are connected to or abut against the second rotating disc 32 at the other end. For ease of description, the end of the first elastic member 41 that is connected to the second rotating disc 32 is defined as a first fixed end A, and the other end thereof is defined as a movable end B. The end of the second elastic member 42 that is connected to the second rotating disc 32 is defined as a second fixed end, and the other end thereof is defined as a second movable end. Both the first fixed end A and the second fixed end are offset from the rotation axis.

When the first rotating disc 31 is rotate forwardly relative to the second rotating disc 32 by an external force in a forward rotation direction, at least the first elastic member 41 of the first elastic member 41 and the second elastic member 42 elastically deform, and generates a first elastic restoring force that causes the first rotating disc 31 to tend to rotate reversely relative to the second rotating disc 32, and the first elastic restoring force drives the first rotating disc 31 to rotate reversely to return to its initial position when the external force in the forward rotation direction on the first rotating disc 31 is removed.

When the first rotating disc 31 is rotated reversely relative to the second rotating disc 32 by an external force in a reverse rotation direction, at least the second elastic member 42 of the first elastic member 41 and the second elastic member 42 elastically deform, and generates a second elastic restoring force that causes the first rotating disc 31 to tend to rotate forwardly relative to the second rotating disc 32, and the second elastic restoring force drives the first rotating disc 31 to rotate forwardly to return to its initial position when the external force in the reverse rotation direction on the first rotating disc 31 is removed.

The first elastic member 41 and the second elastic member 42 are arranged and the first rotating disc 31 and the second rotating disc 32 can return to their initial positions after the external force is removed regardless of forward rotation or reverse rotation. In combination with the foregoing, if the rotation axis is parallel to the extension direction of the bristles, the toothbrush can protect both the upper teeth and the lower teeth when alternately brushing the upper teeth and the lower teeth.

The first elastic member 41 and the second elastic member 42 may be a strip-shaped elastic member, a structural element such as a torsion spring that can be elastically bent at two ends under force, or a structural element such as a helical spring that is subjected to elastic tension or elastic compression at two ends under force.

It should be noted that, in this embodiment, the first fixed end A and the second fixed end may be fixedly or rotatably connected to the second rotating disc 32, and the first movable end B and the second movable end may be fixedly or rotatably connected to the first rotating disc 31.

Figure 5:
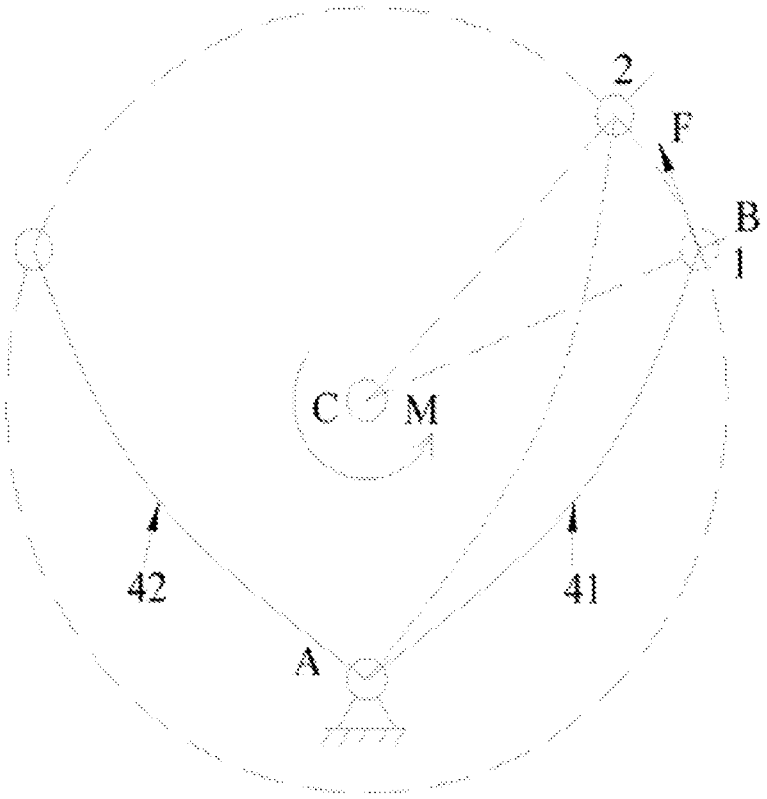
FIG. 5 is a schematic view of mechanical analysis of a first elastic member when a head rotates according to an embodiment of the present application.

With respect to FIG. 5, the first elastic member 41 and the second elastic member 42 are shown as strip-shaped structures. Assuming that the second rotating disc 32 is fixed and the first rotating disc 31 is rotatable. The rotation axis is shown as a center point C on a rotation plane. The first elastic member 41 has a first fixed end A and a first movable end B, and the first fixed end A is connected to the second rotating disc 32, and the first movable end B is connected to or abuts against the first rotating disc 31. When the first rotating disc 31 rotates counterclockwise (direction M in the view) about the center point C, the first movable end B is subjected to a force F, and under the action of the force F, moves from one position to another position about the center point C. The first fixed end A is offset from the rotation axis, that is, the first fixed end A does not coincides with the center point C. A triangle is formed among the point A, the point B, and the point C. When the point B moves from one position to another position, the first elastic member 41 elastically deforms, and after the external force is removed, the first elastic member 41 returns from one position to another position under the elastic restoring force, to drive the first rotating disc 31 to rotate to its initial position.

The second elastic member 42 and the first elastic member 41 are arranged symmetrically. When the first rotating disc 31 rotates counterclockwise about the center point C, the second elastic member 42 is elastically bent and drives the first rotating disc 31 to reversely rotate to return to its initial position after the external force is removed. The second elastic member 42 and the first elastic member 41 are arranged symmetrically and the first elastic member 41 and the second elastic member 42 have the same amount of elastic deformation when the first rotating disc 31 rotates forwardly or reversely relative to the second rotating disc 32. In combination with the foregoing, if the rotation axis is parallel to the extension direction of the bristles, when the upper teeth and the lower teeth are brushed alternately by the toothbrush, under the same brushing force, the upper teeth and the lower teeth are subjected to generally the same force and cleaning effect to improve brushing comfort.

In the structure shown in FIG. 5, the first fixed end A coincides with the second fixed end for the simplicity of the structure. In other embodiments, the first fixed end A may not coincide with the second fixed end.

Referring to FIG. 5, the first elastic member 41 and the second elastic member 42 are elongated strip structures, and can be further bent or stretched if the first elastic member 41 and the second elastic member 42 extend along curve paths, and in bent and stretched cases, the first elastic member and the second elastic member can recover to their original shapes under the action of their own elastic restoring forces. In this case, the first movable end B and the second movable end may be movably or fixedly connected to or abut against the first rotating disc 31.

However, if the first elastic member 41 and the second elastic member 42 are elongated rods, and extend along straight paths, the first elastic member 41 and the second elastic member 42 can only be elastically bent and difficult to stretch. With respect to FIG. 5, it is assumed that the first movable end B of the first elastic member 41 is initially at a position 1 and the first elastic member 41 extends along a straight line, since the linear distance between a position 2 and the first fixed end A is greater than the linear distance between the position 1 and the first fixed end A, it is difficult for the first movable end B to move to the position 2. If the first movable end B is fixedly or rotatably connected to the first rotating disc 31, the first rotating disc 31 is limited by the length of the first elastic member 41 and cannot rotate counterclockwise. If the first movable end B abut against the first rotating disc 31, the second movable end elastically deform only when the first rotating disc 31 rotates clockwise, and the second movable end is separated from the first rotating disc 31 when the first rotating disc rotates counterclockwise. In this case, the first elastic member 41 returns to its initial position after the first rotating disc 31 rotates clockwise, and the second elastic member 42 returns to its initial position after the first rotating disc 31 rotates counterclockwise.

It can be seen from the above the first elastic member 41 and the second elastic member 42 are strip-shaped structures, and may extend along straight or curved paths. The first movable end B and the second movable end may abut against the second rotating disc 32, to reduce the difficulty of structure production and machining.

Figure 2:
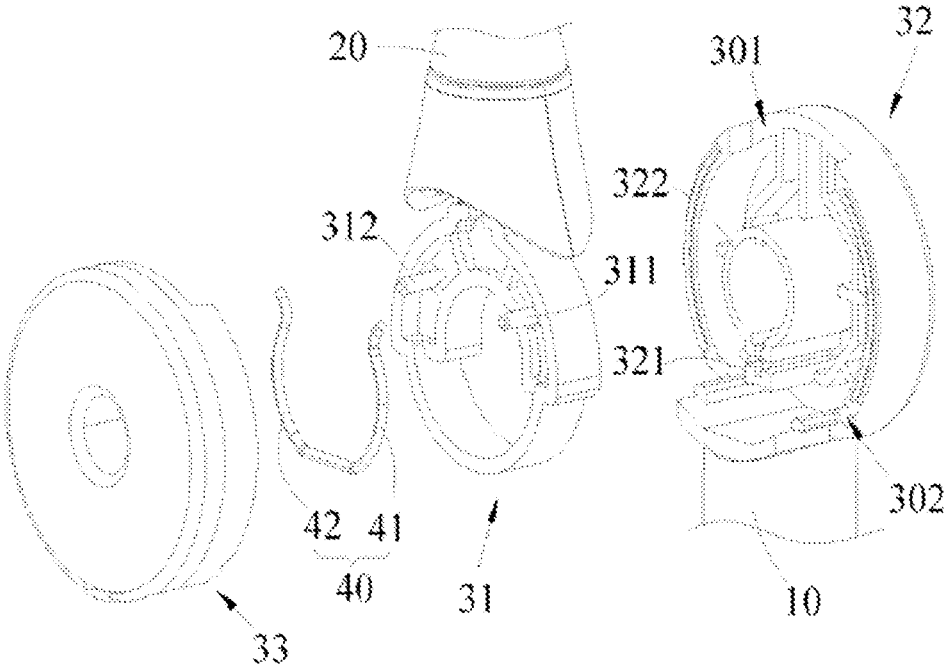
FIG. 2 is a schematic partially exploded view of the toothbrush according to an embodiment of the present application.
Figure 3:
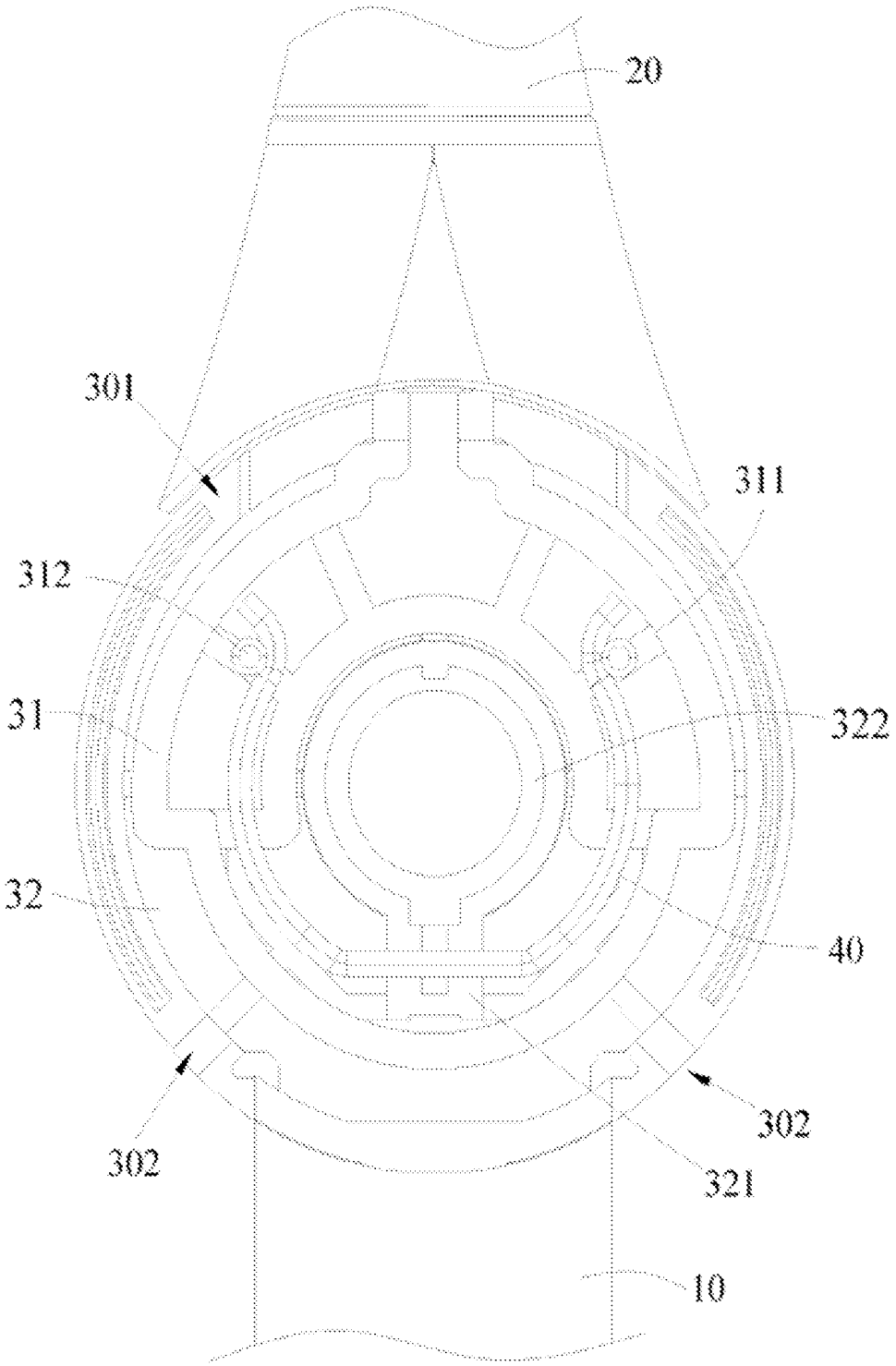
FIG. 3 is a schematic view of a connection between an elastic structure and a connection structure according to an embodiment of the present application.

It should be noted that if both the first movable end B and the second movable end abut against the first rotating disc 31, the first movable end B and the second movable end are limited to rotation about the center point C. This effect can be achieved as follows:

Referring to FIGS. 2 and 3, the first rotating disc 31 is provided with a first protruding post 311 and a second protruding post 312, the first protruding post 311 and the second protruding post 312 respectively abutting against the first movable end B and the second movable end.

The first elastic member 41 and the second elastic member 42 respectively abut against the first protruding post 311 and the second protruding post 312. When the first rotating disc 31 rotates clockwise, the first protruding post 311 presses against the first elastic member 41 to cause the first elastic member 41 to elastically deform. When the second rotating disc 32 rotates counterclockwise, the second protruding post 312 presses against the second elastic member 42 to cause the second elastic member 42 to elastically deform.

Figure 4:
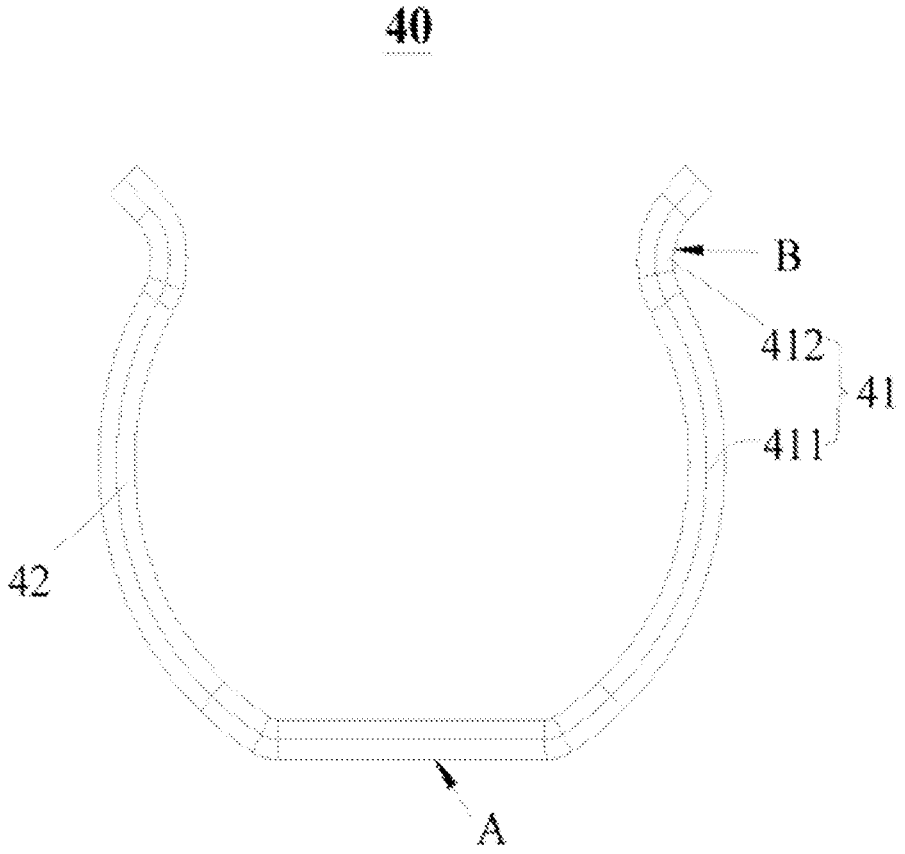
FIG. 4 is a schematic view of an elastic structure according to an embodiment of the present application.

In another embodiment of the present application, referring to FIG. 4, both the first elastic member 41 and the second elastic member 42 are rod-shaped structures and integrally provided, and the connection between the first elastic member 41 and the second elastic member 42 is the first fixed end A/second fixed end. The first fixed end A coincides with the second fixed end and only one fixing structure needs to be provided for the second rotating disc 32 to facilitate the simplicity of the structure.

In another embodiment of the present application, referring to FIGS. 3 and 4, the second rotating disc 32 is provided with a clamping block 321, and the clamping block 321 has a clamping groove. The first elastic member 41 and the second elastic member 42 are connected and clamped in the clamping groove at the connection. The first elastic member 41 and the second elastic member 42 are generally U-shaped as whole, and are clamped in the clamping groove at the first fixed end A. The clamping groove restricts the movement of the elastic structure 40 in a horizontal plane, including the movements in the left-right direction and in the front-rear direction. This arrangement facilitates the simplicity of the structure and facilitates operations.

Referring to FIG. 2, the first protruding post 311 and the second protruding post 312 are cylindrical. In other embodiments, the first protruding post 311 and the second protruding post 312 may also be in the form of a truncated cone or in other forms, which are not limited herein.

Referring to FIG. 3, free ends of the first elastic member 41 and the second elastic member 42 are located between the first protruding post 311 and the second protruding post 312. In other embodiments, the free ends of the first elastic member 41 and the second elastic member 42 may also be located outside the first protruding post 311 and the second protruding post 312.

Referring to FIG. 4 together, the first elastic member 41 has a first arc-shaped section 411 whose arc center faces the rotation axis and a second arc-shaped section 412 (the first movable end B) whose arc center faces the first protruding post 311. The first elastic member 41 and the second elastic member 42 are symmetrical, and the first protruding post 311, the second protruding post 312 and the clamping groove of the clamping block 321 jointly clamp the elastic structure 40 therein, and the arrangements of the first arc-shaped section 411 and the second arc-shaped section 412 facilitate improving connection robustness between the entirety of the elastic structure 40 and the first rotating disc 31 and the second rotating disc 32.

In another embodiment of the present application, referring to FIG. 2, a surface of the second rotating disc 32 facing the first rotating disc 31 is provided with a rotating cylinder 322, and the first rotating disc 31 is sleeved on the rotating cylinder 322 and rotates around the rotating cylinder 322.

The connection structure 30 further includes a snap-fit member 33, the snap-fit member 33 is in snap fit with the second rotating disc 32 to clamp the first rotating disc 31 therein, and the snap-fit member 33 and/or the second rotating disc 32 are provided with an avoidance opening 301 to avoid the connection between the first rotating disc 31 and the head 20.

The snap-fit member 33 is in snap fit with the second rotating disc 32 to form an accommodating cavity for accommodating the first rotating disc 31. The first rotating disc 31 is placed inside the accommodating cavity and sleeved on the outside of the rotating cylinder 322. The central axis of the rotating cylinder 322 is the rotation axis. The head 20 is connected to the first rotating disc 31 by a connector or the head 20 itself passes through the avoidance opening 301 and is then connected to the first rotating disc. The avoidance opening 301 limits the maximum rotation angle of the head 20 and the handle 10.

Referring to FIGS. 2 and 3, the snap-fit member 33 and/or the second rotating disc 32 is provided with a drain hole 302 communicating with the accommodating cavity. In use, water from outside may enter the accommodating cavity through the avoidance opening 301. In the illustrated structure, two drain holes 302 which are arranged on two sides of the handle 10 are provided. The arrangement of the drain hole 302 allows the water in the accommodating cavity to be drained in time.

In another embodiment of the present application, the toothbrush further includes a sensing structure for detecting the pressure on the head 20. The sensing structure senses the pressure on the head 20, and when the sensed pressure is greater than a predetermined threshold, an alarm signal is sent in the form of visible light or sound to remind the user to properly reduce the pressure applied to the toothbrush.

The foregoing descriptions are some embodiments of the present application, and are not intended to limit the present application. Any modification, equivalent substitute, or improvement made without departing from the spirit and principle of the present application shall fall within the scope of protection of the present application.

What is claimed is:

1. A toothbrush, comprising:

a handle placed upright and whose long sides extend vertically;

a head having bristles for brushing teeth;

a connection structure comprising a first rotating disc and a second rotating disc which are arranged coaxially and rotatable relative to each other, the first rotating disc being connected to the head or handle and the second rotating disc being connected to the handle or head, and a rotation axis of the first rotating disc and the second rotating disc being perpendicular to an extension direction of the handle; and an elastic structure comprising a first elastic member and a second elastic member, both the first elastic member and the second elastic member are strip-shaped structures and integrally provided, wherein the first elastic member and second elastic member are connected to or abutted against the first rotating disc at their first ends, the first elastic member and second elastic member are connected to the second rotating disc at a connection of the first elastic member and the second elastic member; and when the first rotating disc rotates relative to the second rotating disc under an action of an external force, at least one of the first elastic member and the second elastic member elastically deform to generate an elastic restoring force that drives the first rotating disc to rotate reversely to return to its initial position after the external force is removed, the rotation axis is parallel to an extension direction of the bristles.

2. The toothbrush of claim 1, wherein the first elastic member and the second elastic member extend along straight or curved paths.

3. The toothbrush of claim 1, wherein the second elastic member and the first elastic member are arranged symmetrically.

4. The toothbrush of claim 1, wherein the second rotating disc is provided with a clamping block having a clamping groove; and the connection of the first elastic member and the second elastic member are clamped in the clamping groove.

5. The toothbrush of claim 1, wherein the first rotating disc is provided with a first protruding post and a second protruding post, the first protruding post and the second protruding post respectively abutting against the first elastic member and the second elastic member.

6. The toothbrush of claim 5, wherein the first ends of the first elastic member and the second elastic member are located between the first protruding post and the second protruding post.

7. The toothbrush of claim 5, wherein the first protruding post and the second protruding post are cylindrical.

8. The toothbrush of claim 6, wherein the first elastic member has a first arc-shaped section whose arc center faces the rotation axis and a second arc-shaped section whose arc center faces the first protruding post.

9. The toothbrush of claim 1, wherein a surface of the second rotating disc facing the first rotating disc is provided with a rotating cylinder, and the first rotating disc is sleeved on the rotating cylinder and rotates around the rotating cylinder; and the connection structure further comprises a snap-fit member, which is in snap fit with the second rotating disc to form an accommodating cavity for accommodating the first rotating disc, and the snap-fit member and/or the second rotating disc are provided with an avoidance opening to avoid a connection between the first rotating disc and the head.

10. The toothbrush of claim 9, wherein the snap-fit member and/or the second rotating disc is provided with a drain hole communicating with the accommodating cavity.

11. The toothbrush of claim 10, wherein two drain holes which are arranged on two sides of the handle are provided.

* * * * *